US010354811B2

(12) United States Patent
Rival et al.

(10) Patent No.: US 10,354,811 B2
(45) Date of Patent: Jul. 16, 2019

(54) ELECTRICAL CIRCUIT BREAKER WITH CONTACT FINGERS HAVING CUSTOMIZED CONTACT PRESSURE

(71) Applicant: Schneider Electric Industries SAS, Rueil Malmaison (FR)

(72) Inventors: Marc Rival, Bernin (FR); Eric Domejean, Voreppe (FR); Min Xu, Shanghai (CN)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/669,019

(22) Filed: Aug. 4, 2017

(65) Prior Publication Data

US 2018/0075983 A1 Mar. 15, 2018

(30) Foreign Application Priority Data

Sep. 15, 2016 (FR) ..... 16 58621

(51) Int. Cl.
*H01H 1/50* (2006.01)
*H01R 13/24* (2006.01)
(Continued)

(52) U.S. Cl.
CPC ..... *H01H 1/50* (2013.01); *H01H 1/226* (2013.01); *H01H 1/54* (2013.01); *H01H 73/04* (2013.01);
(Continued)

(58) Field of Classification Search
CPC ..... H01H 1/221; H01H 1/226; H01H 1/50; H01R 13/2421
(Continued)

(56) References Cited

U.S. PATENT DOCUMENTS 3,662,134 A * 5/1972 Cellerini ..... H01H 1/226 218/21
4,713,508 A * 12/1987 Baginski ..... H01H 3/30 185/45
(Continued)

FOREIGN PATENT DOCUMENTS

DE 35 44 668 A1 6/1987
EP 1202303 * 2/2002 ..... H01H 1/50
EP 1 202 303 A2 5/2002

OTHER PUBLICATIONS

Ansys, Inc., Lorentz Forces in Switches and Contacts, Application Brief, 2012.*
(Continued)

*Primary Examiner* — Vanessa Girardi
(74) *Attorney, Agent, or Firm* — Oblon, McClelland, Maier & Neustadt, L.L.P.

(57) ABSTRACT

An electrical circuit breaker with separable electrical contacts includes a fixed electrical contact, a mobile electrical contact, that can be displaced between open and closed positions and including several electrical contact fingers, arranged aligned along a row and that can be displaced relative to the mobile electrical contact, several bearing members, each associated with a contact finger to exert a force on this contact finger in order to displace it. The bearing members associated with the contact fingers situated in lateral end zones of the row exhibit a higher stiffness than the bearing members associated with the contact fingers situated in a central part of the row.

9 Claims, 4 Drawing Sheets

(51) Int. Cl.
*H01H 1/22* (2006.01)
*H01H 1/54* (2006.01)
*H01H 73/04* (2006.01)

(52) U.S. Cl.
CPC ..... *H01R 13/2421* (2013.01); *H01H 2235/01* (2013.01)

(58) Field of Classification Search
USPC ..... 200/251, 290; 218/17; 335/171, 335/192–194
See application file for complete search history.

(56) References Cited

U.S. PATENT DOCUMENTS

| | | | | |
|---|---|---|---|---|
| 6,570,116 | B2 * | 5/2003 | Maulandi | H01H 1/226 218/22 |
| 2003/0034332 | A1 | 2/2003 | Maulandi et al. | |
| 2012/0199449 | A1 | 8/2012 | Fong et al. | |

OTHER PUBLICATIONS

French Preliminary Search Report dated Jun. 16, 2017 in French Application 16 58621, filed on Sep. 15, 2016 (with English Translation of Categories of cited documents).

* cited by examiner

ELECTRICAL CIRCUIT BREAKER WITH CONTACT FINGERS HAVING CUSTOMIZED CONTACT PRESSURE

The invention relates to an electrical circuit breaker with separable electrical contacts.

Low-voltage and air-breaking electrical circuit breakers are known comprising separable electrical contacts, typically a fixed electrical contact which cooperates with a mobile electrical contact. The patent EP-0410902-B1 describes an example of such a circuit breaker.

The mobile contact can be displaced between open and closed positions of the circuit breaker and is provided with several contact fingers mounted to pivot relative to the mobile contact. These contact fingers are configured to be displaced, under the action of a spring, when the mobile contact is displaced from the closed position to the open position. More specifically, the contact fingers pivot under the effect of the springs as soon as the electrical contacts, initially in electrical contact with one another, begin to separate from one another from the closed position.

In this way, the electrical arc-formation zone between the electrical contacts is displaced toward the arc-distinguishing chamber, which reduces the wear of the contact pads with which the electrical contacts are provided. That thus improves the electrical endurance of the circuit breaker.

These known circuit breakers are not however entirely satisfactory in the presence of electrical currents of high intensity, typically for a compact low-voltage and high-intensity circuit breaker, when the value of the admissible rated short-term electrical current in the circuit breaker is high, for example equal to 50 kA for 1 second.

It is these drawbacks that the invention sets out more particularly to remedy by proposing a low-voltage electrical circuit breaker with separable contacts, provided with mobile contact fingers, capable of operating with electrical currents of high intensity while exhibiting a good mechanical endurance.

To this end, the invention relates to an electrical circuit breaker with separable electrical contacts, comprising:

- a fixed electrical contact, connected electrically to a first connection terminal of the circuit breaker,
- a mobile electrical contact, connected to a second connection terminal of the circuit breaker, this mobile electrical contact being able to be displaced, relative to the fixed electrical contact, between open and closed positions, this mobile electrical contact comprising:
  - several electrical contact fingers, arranged aligned along a row and that can be displaced relative to a frame of the mobile electrical contact, these contact fingers being adapted to ensure an electrical contact with the fixed electrical contact when the mobile electrical contact is in the closed position,
  - several bearing members, each being associated with a contact finger to exert a force on this contact finger in order to displace it, in which the bearing members associated with the contact fingers situated in lateral end zones of the row exhibit a higher stiffness than the bearing members associated with the contact fingers situated in a central part of the row.

By virtue of the invention, only the contact fingers situated in the lateral end zones of the row are associated with a bearing member with augmented stiffness. These bearing members allow the contact fingers to be displaced despite the high value of the electrical currents. In effect, the electromagnetic forces opposing the bearing members by virtue of these electrical current values are greater at the row-end level than at the row-middle level.

Thus, only the bearing members which have to locally oppose a greater electromagnetic force are dimensioned to oppose this force, whereas the bearing members situated in the middle of the row are not over dimensioned, which reduces the risk of premature mechanical breakage of the circuit breaker. In effect, it is desirable for the circuit breaker to have a high mechanical endurance, for example for it to be capable of supporting at least ten thousand electrical contact opening and closing cycles.

In this way, the invention makes it possible to obtain a satisfactory compromise between, on the one hand, the need for the springs to exert a contact pressure force that is sufficient to keep the electrical contact fingers closed despite the forces linked to the short-term current Icw and, on the other hand, the need to guarantee a good mechanical endurance of the circuit breaker.

According to advantageous but non-mandatory aspects of the invention, such a circuit breaker can incorporate one or more of the following features, taken in isolation or in any technically admissible combination:

- The ratio between the stiffness of the bearing members associated with the contact fingers situated in the lateral end zones of the row on the one hand and the stiffness of the bearing members associated with the contact fingers situated in the central part of the row on the other hand lie within the range 1.33-2.
- The mobile contact comprises five contact fingers, each of the bearing members associated with the contact fingers situated in the lateral end zones of the row exerts a force greater than or equal to 12 dN on the corresponding contact finger, the bearing members associated with the contact fingers situated in the central part of the row exert a force greater than or equal to 9 dN less than 12 dN on the corresponding contact finger.
- Each elastic bearing member comprises an inner spring and an outer spring nested and arranged coaxially along a longitudinal axis of the elastic bearing member and being adapted to exert together said force to displace the corresponding contact finger.
- The inner and outer springs are helical compression springs.
- The bearing members associated with the contact fingers situated in the lateral end zones of the row have a height similar to the height of the bearing members associated with the contact fingers situated in the central part of the row, for example equal to within less than 10%, preferably equal to within less than 5%.
- Each bearing member is received in a corresponding recess formed in the frame of the mobile electrical contact, the springs associated with the contact fingers situated in the lateral end zones of the row have a first outer diameter, the bearing members associated with the contact fingers situated in the central part of the row have a second outer diameter different from the first diameter.
- The second diameter is greater than the first diameter.
- The bearing members associated with the contact fingers situated in the lateral end zones of the row are identical to one another.
- The bearing members associated with the contact fingers situated in a central part of the row are identical to one another.

The invention will be better understood and other advantages thereof will become more clearly apparent in light of the following description, of an embodiment of a circuit breaker given purely as an example and with reference to the attached drawings in which:

FIGS. 1 and 2 represent a circuit breaker 2 intended to be used in an electrical circuit, in order to make it possible to interrupt an electrical current supply of this electrical circuit, for example when an operating fault is detected, such as a short circuit or an overcurrent.

Figure 1:
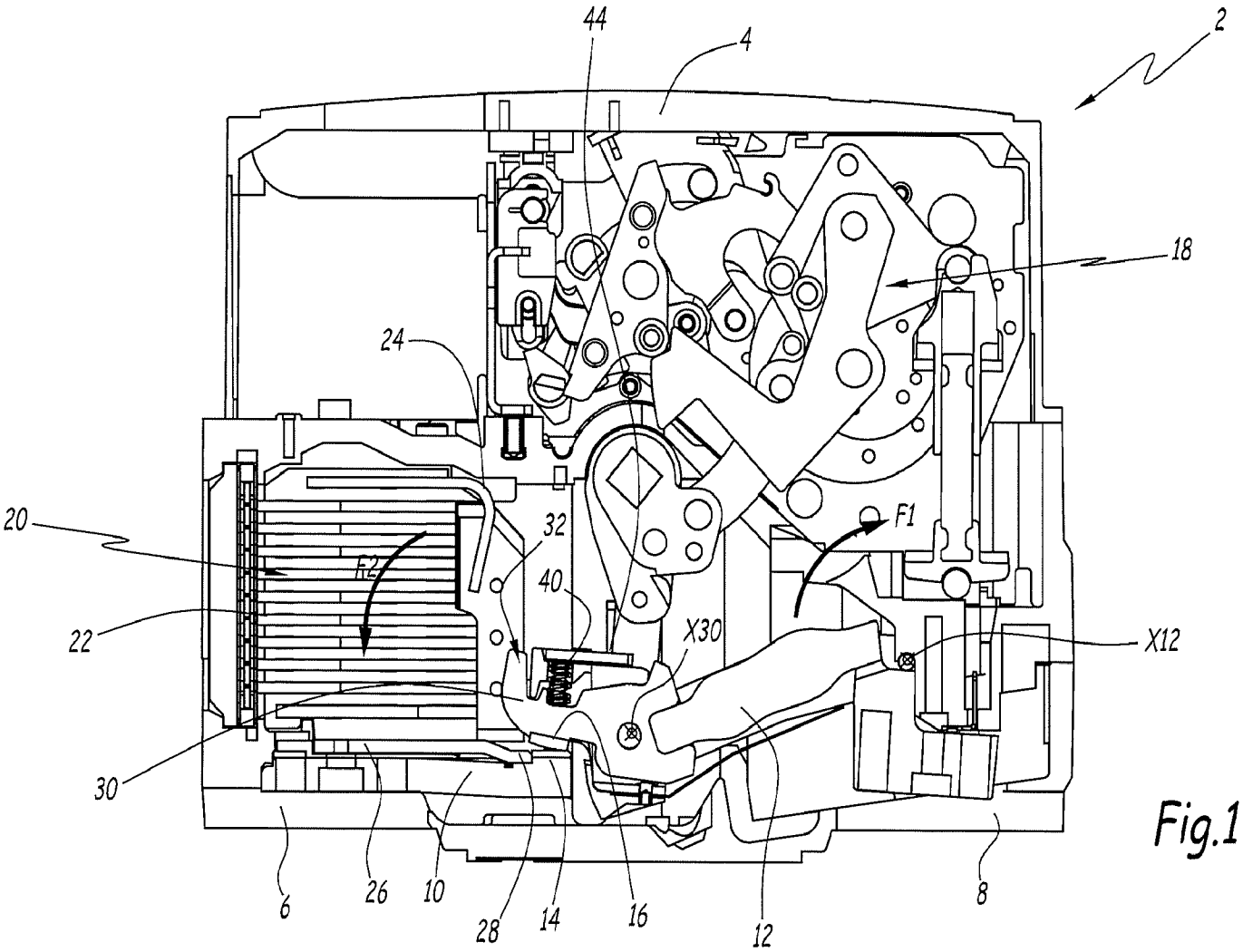
FIGS. 1 and 2 are schematic representations, according to a transverse cross-sectional view, of an electrical circuit breaker with separable contacts according to the invention, the separable contacts being respectively illustrated in closed and open positions.

In this example, the circuit breaker 2 is a low-voltage and alternating current circuit breaker, designed for an electrical voltage less than or equal to 690 V AC and for electrical currents of nominal intensity less than or equal to 1600 A. For example, the circuit breaker 2 is capable of supporting admissible rated short-term currents of an intensity less than or equal to 50 kA for 1 second.

In this example, the circuit breaker is a multi-pole circuit breaker, designed to be used in an electrical circuit having several electrical phases, such as a three-phase electrical circuit. Each pole of the circuit breaker 2 then corresponds to an electrical phase of the electrical circuit.

To simplify the description, only one of the poles of the circuit breaker 2 is described in detail. The constituent parts of the circuit breaker 2 associated with the other poles are similar and are not described in detail in as much as the description which follows can be transposed to them.

The circuit breaker 2 comprises a casing 4 and input/output terminals 6 and 8 for an electrical current. The terminals 6 and 8 are capable of connecting the circuit breaker 2 to a pole of the electrical circuit, for example via a connection bus bar of an electrical switchboard.

The terminals 6 and 8 are produced in an electrically conductive material, for example copper.

The circuit breaker 2 also comprises separable electrical contacts 10 and 12. The electrical contacts 10 and 12 can be displaced relative to one another, selectively and reversibly, between open and closed positions, so as to, respectively, authorize or inhibit the circulation of an electrical current between the terminals 6 and 8 for this electrical pole of the circuit breaker 2.

The electrical contacts 10 and 12 each bear one or more electrical contact pads, respectively denoted 14 and 16, which are connected electrically, respectively, to the terminals 6 and 8. The contact pads 14 and 16 are produced in an electrically conductive material, such as copper or an alloy of silver.

In the closed position, illustrated in FIG. 1, the contact pads 14 and 16 are in direct contact with one another, thus allowing the circulation of an electrical current between the terminals 6 and 8.

Figure 2:
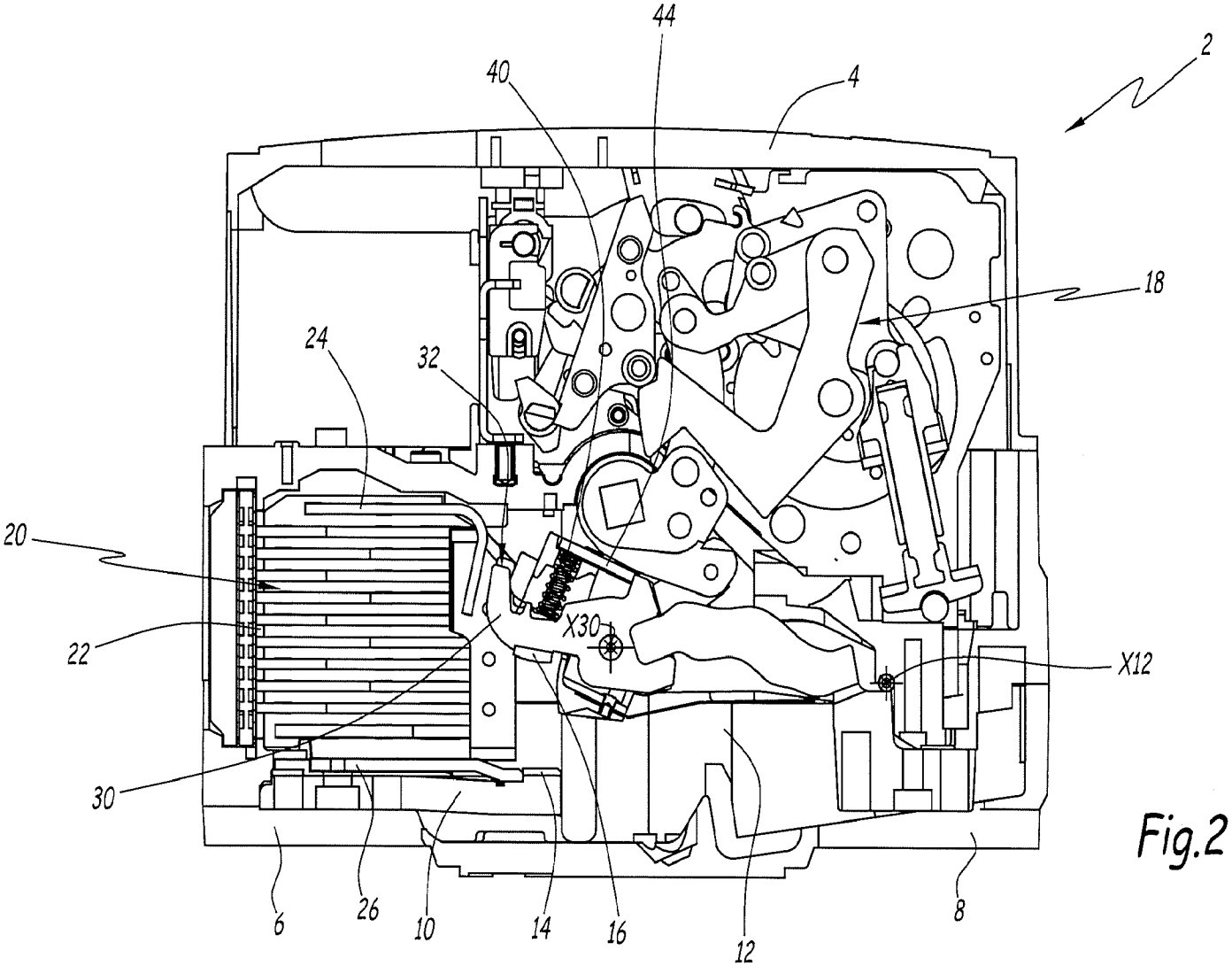

In the open position, as illustrated in FIG. 2, the electrical conductors 10 and 12 and in particular the contact pads 14 and 16, are away from one another. When no electrical arc is present between these contact pads 14 and 16, the electrical current is prevented from circulating between the terminals 6 and 8 associated with this pole of the circuit breaker 2.

The circuit breaker 2 further comprises a displacement mechanism 18, configured to displace the electrical contacts 10 and 12 relative to one another, between the open and closed positions, for example in response to the detection of an abnormal situation, such as an overcurrent of the electrical current circulating for this pole of the circuit breaker 2. Such a displacement mechanism 18 is well known and is not therefore described in more detail hereinbelow.

In this example, the electrical contact 10 is fixed relative to the casing 4. The contact 12 is mobile in displacement relative to the fixed electrical contact 10 between the open and closed positions, by virtue of the displacement mechanism 18.

More specifically, the mobile electrical contact 12 is mounted to pivot relative to the casing 4, by means of a pivot link, about a fixed axis X12 of the circuit breaker 2. The displacement of the mobile electrical contact 12, from the closed position to the open position, is therefore done by rotation about the axis X12, in a first direction of rotation, illustrated by the arrow F1 in FIG. 1. This pivot link is here formed at a distal end of the mobile electrical contact 12.

When the mobile electrical contact 12 is displaced to the open position away from the fixed electrical contact 10, when an electrical current is circulating in this pole of the circuit breaker 2 between the terminals 6 and 8, an electrical arc can be formed between the electrical contacts 10 and 12. This electrical arc must be extinguished to stop the circulation of the current between the terminals 6 and 8.

To do this, the circuit breaker 2 comprises an electrical arc extinguishing chamber 20. This extinguishing chamber 20 is placed inside the casing 4, facing the contact pads 14 and 16 so as to receive an electrical arc upon the formation of such an electrical arc between the pads 14 and 16.

As is known, such an extinguishing chamber 20 comprises a stack of separation plates 22 framed by a top arc horn 24 and by a bottom arc horn 26, respectively arranged at top and bottom ends of the stack of the plates 22.

The separation plates 22 are capable of extinguishing such an electrical arc by splitting it up and/or by partially absorbing its energy when the electrical arc enters into contact with these separation plates 22. The purpose of the horns 24 and 26 is to guide the electrical arc to the separation plates 22.

The bottom horn 26 is here provided with an electrical contact land 28 connected electrically to the terminal 6.

The mobile electrical contact 12 further comprises several electrical contact fingers 30, mobile relative to a frame 34, or cage, of the mobile electrical contact 12. More specifically, the contact fingers 30 are mounted to pivot relative to the frame 34 by means of a pivot link, about an axis X30 secured to the body of the mobile electrical contact 12. The axis X30 is arranged parallel to the axis X12. Thus, the contact fingers 30 can be displaced in rotation about the axis X30 between first and second distinct positions.

The function of the contact fingers 30 is to ensure a temporary electrical contact between the electrical contacts 10 and 12 upon the displacement of the electrical contact 12 from the closed position to the open position, as explained hereinbelow.

In this example, the contact fingers 30 are arranged at the proximal end of the body of the mobile electrical contact 12. The proximal end is opposite the distal end.

The contact fingers 30 are aligned with one another along a rectilinear row, parallel to the axis X30.

The contact fingers 30 are identical to one another and are secured to one another, so as to be displaced simultaneously together relative to the rest of the mobile electrical contact 12.

The contact fingers 30 are produced in an electrically conductive material, such as copper.

Each contact finger 30 is connected electrically to the electrical terminal 8, via electrical connection elements, not illustrated, such as braided copper cables. The contact pads 16 of the mobile contact 12 are formed on the contact fingers 30. More specifically, a contact pad 16 is directly mounted on a bottom face of each of the contact fingers 30.

Figure 3:
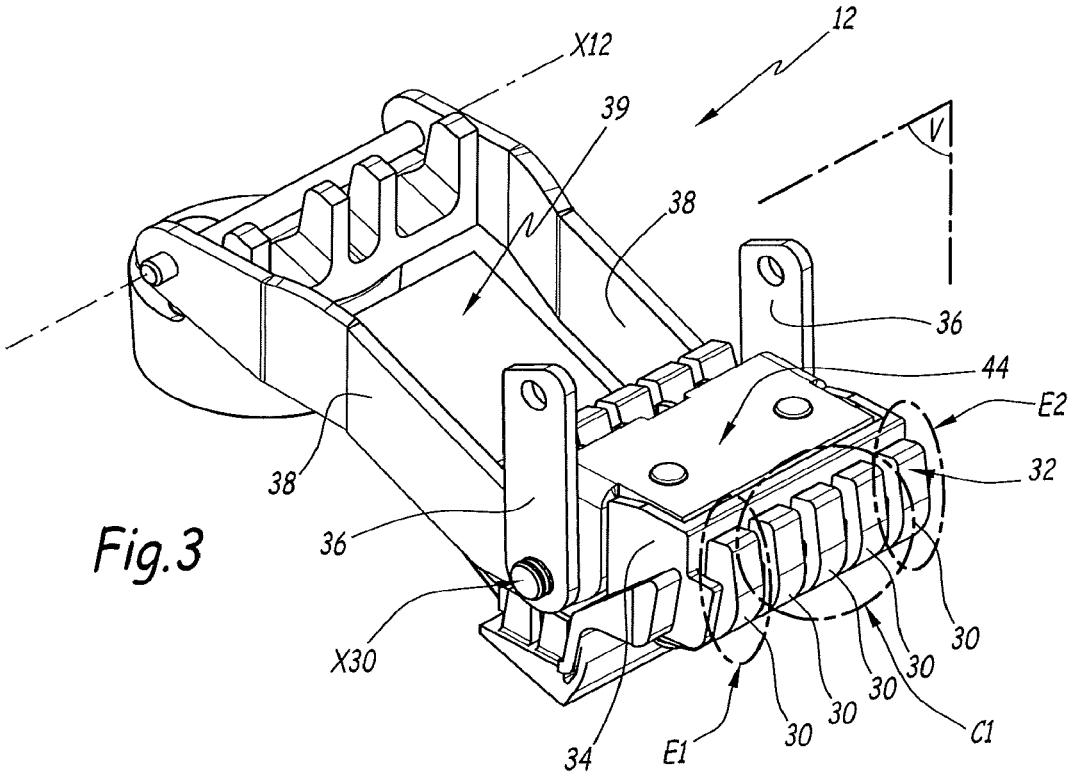
FIG. 3 is a schematic representation, according to a perspective view, of the mobile electrical contact of the circuit breaker of FIGS. 1 and 2.
Figure 4:
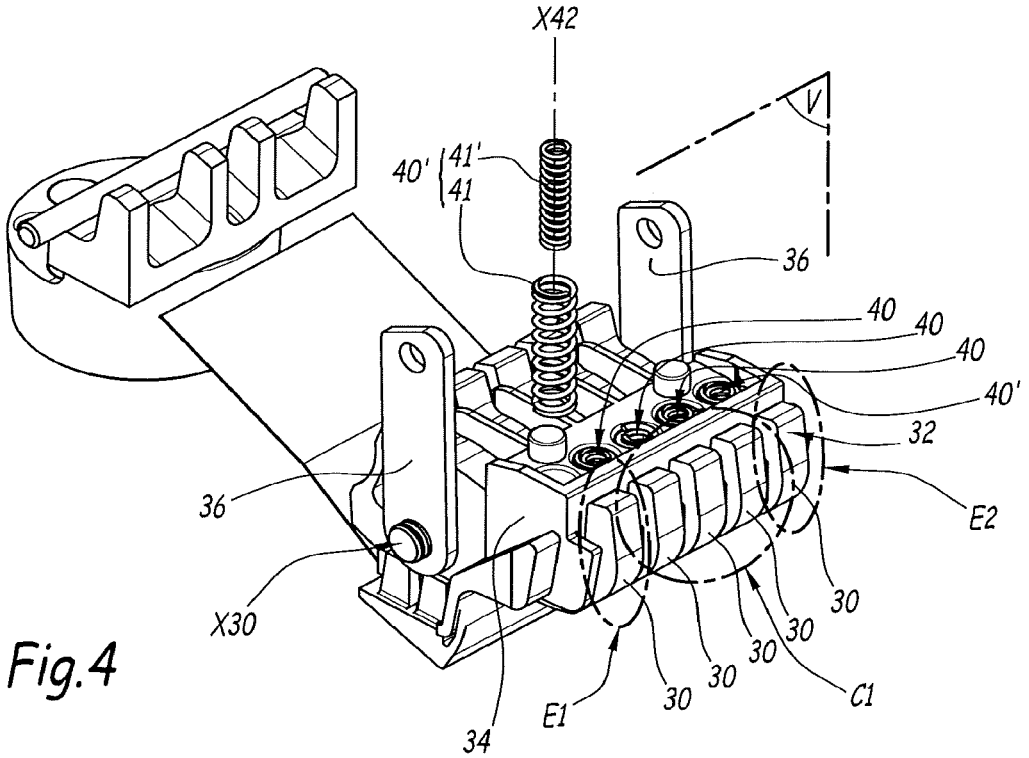
FIG. 4 is a schematic representation, according to an exploded view, of the mobile electrical contact of FIG. 3.
Figure 5:
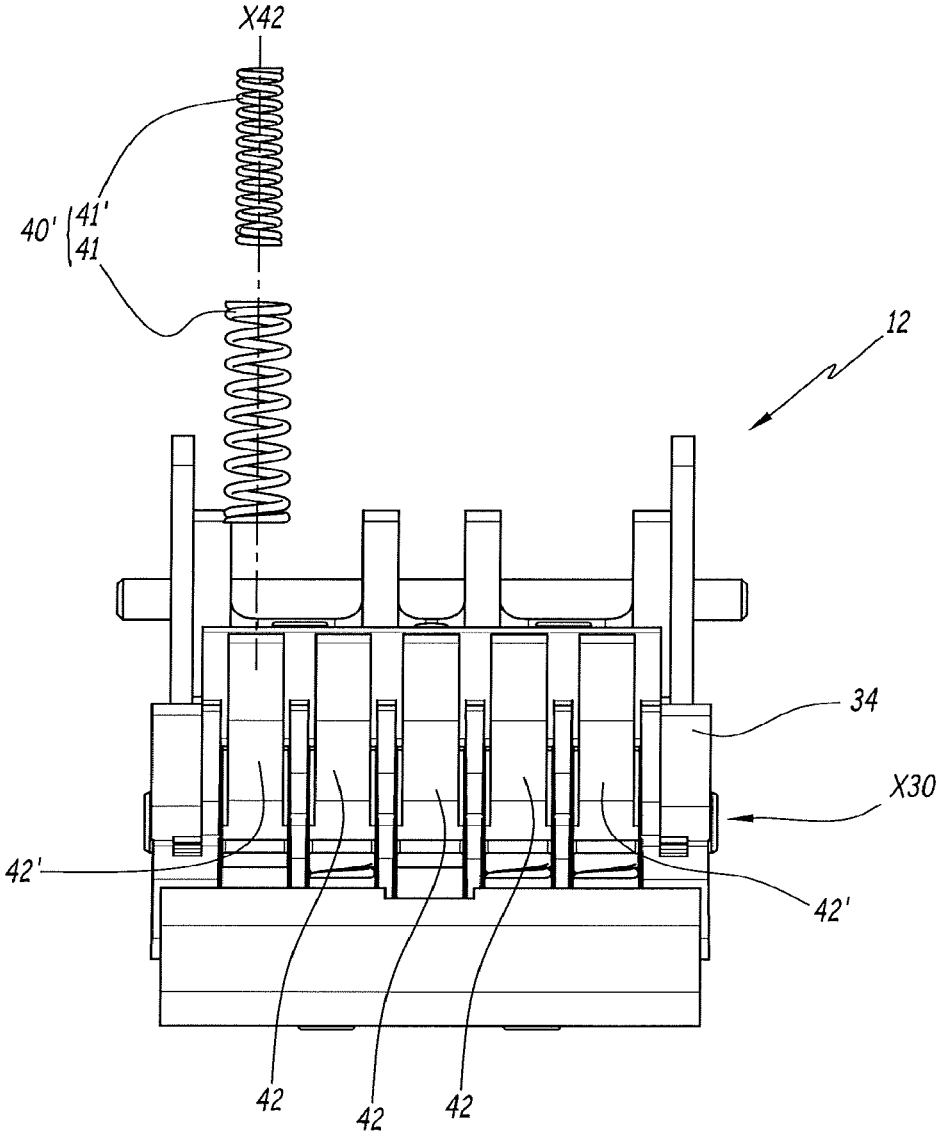
FIG. 5 is a representation of the mobile electrical contact of FIG. 4, according to the cutting plane V of FIG. 4.

FIGS. 3 to 5 represent in more detail an example of the mobile electrical contact 12 and of the contact fingers 30.

E1 and E2 are used to denote opposite lateral end zones of the row along which the contact fingers 30 are aligned. C1 is used to denote a central part of this row. The central part C1 encompasses the contact fingers 30 of the row which are not in one or other of the lateral end zones E1 and E2.

In this example, only a single contact finger 30 is situated in the lateral end zone E1 of the row. Similarly, only a single contact finger 30 is situated in the opposite lateral end zone E2 of the row. The other contact fingers 30 are situated in the central part C1 of the row.

In this example, the contact fingers 30 each have an elongate part, essentially rectilinear, which is prolonged, on one of its ends, by a bent part 32 rising upwards towards a top face of the mobile contact 12.

The mobile contact 12 comprises the frame 34 to which the contact fingers 30 are fixed by means of the pivot link. This frame 34 is located at the proximal end of the mobile electrical contact 12.

The contact fingers 30 are here situated under a bottom face of the frame 34, such that their respective elongate parts extend parallel to this bottom face of the frame 34 when they are in their first position.

This frame 34 is linked to the displacement mechanism 18 by virtue of motion transmitting connecting rods 36. For greater clarity, these connecting rods 36 are not illustrated in FIGS. 1 and 2.

The mobile electrical contact 12 comprises, between its two opposite ends, lateral walls 38 which delimit a recess 39. In a mounted configuration of the mobile electrical contact 12, this recess 39 receives the electrical connection elements which link the contact fingers 30 to the terminal 8.

The mobile electrical contact 12 also comprises several elastic bearing members 40, 40', also called "pressure members", each associated with a contact finger 30. Each bearing member 40, 40' is configured to exert a force on the corresponding contact finger 30, so as to displace it from the first position to the second position. Each bearing member 40, 40' comprises at least one spring capable of exerting a force along a longitudinal axis of the corresponding bearing member 40, 40', here by exerting a pressure.

The bearing members associated with the contact fingers 30 situated in the central part C1 of the row bear the reference 40 and are called "first bearing members". The bearing members associated with the contact fingers 30 situated in the lateral end zones E1 and E2 of the row bear the reference 40' and are called "second bearing members".

In this example, each bearing member 40, 40' comprises two springs, here of cylindrical form, arranged coaxially along the longitudinal axis of the bearing member and nested one inside the other. One of these springs, called outer spring, has an outer diameter greater than the outer diameter of the other spring, called inner spring, and delimits an internal cavity in which the inner spring is housed. The inner and outer springs of each bearing member 40, 40' advantageously have a same height here measured along the longitudinal axis. These inner and outer springs are capable of each providing a force along the longitudinal axis of the corresponding bearing member. Thus, the force exerted by each bearing member 40, 40' on the corresponding contact finger 30, 30' is exerted by the inner and outer springs contained in this bearing member 40, 40'.

The bearing members 40, 40' are arranged inside the frame 34. More specifically, the frame 34 here comprises a plurality of recesses 42, 42', each arranged facing a contact finger 30. These recesses 42, 42' are here aligned along a row parallel to the axis X30.

The recesses associated with the first bearing members 40 bear the reference 42. The recesses associated with the second bearing members 40' bear the reference 42'.

The recesses 42, 42' are formed inside the frame 34 and emerge on the contact fingers 30 at the level of a bottom part of these recesses 42, 42' and of the frame 34. The recesses 42 and 42' here have a cylindrical form with circular base and directing axis X42. The height of the recesses 42, 42' is less than the height of the respective bearing members 40, 40' when they are in their deployed state.

In FIGS. 4 and 5, one of the second bearing members 40' is illustrated outside of its recess 42'. The outer spring of this bearing member 40' bears the reference 41, whereas the corresponding inner spring bears the reference 41'. These springs 41 and 41' are, in a mounted configuration of the bearing member 40', aligned along the axis X42. Thus, the axis X42 here forms a longitudinal axis of the bearing member 40' when the latter is received inside the corresponding recess 42'.

The frame 34 is covered, on a top face, by a cap 44, against which a top end of each of the bearing members 40, 40' comes to bear.

In this example, the springs contained in the bearing members 40 and 40' are compression springs and therefore exert a compression force on the contact fingers 30. In the mounted configuration of the mobile contact 12, the bottom end of each of the bearing members 40, 40' bears on the corresponding contact finger 30. These springs are here of helical type.

In the mounted configuration of the mobile contact 12, the bearing members 40, 40' are received in recesses, respectively, 42 and 42' and extend along the directing axis X42 associated with the corresponding recess 42, 42'.

The second bearing members 40' exhibit a higher stiffness than the first bearing members 40 situated in the central part C1. The ratio between the stiffness of each of the two bearing members 40' on the one hand and the stiffness of each first bearing member 40 on the other hand is strictly greater than 1 and, preferably, greater than or equal to 1.05.

Also preferably, the ratio between the stiffness of each of the second bearing members 40' on the one hand and the stiffness of each first bearing member 40 on the other hand lies within the range 1.33-2.

In this example, each second bearing member 40' exerts, on the contact finger 30 with which it is associated, a contact pressure of an intensity greater than or equal to 12 dN. Each first spring 40 exerts, on the contact finger 30 with which it is associated, a contact pressure of intensity greater than or equal to 9 dN and less than or equal to 12 dN.

The first bearing members 40 are here identical to one another and the second bearing members 40' are identical to one another.

The contact pressure force is proportional to the elongation of the bearing member, measured here along the axis X42 when the bearing member is received in the corresponding recess 42, 42'.

In this example, the inner and outer springs of the first bearing member 40 are helical compression springs, here made of metal, such as the stainless steel alloy X10CrNi18-8HS. This inner spring is formed by winding a wire of 0.7 mm diameter and exhibits a stiffness coefficient of 4.88 N/mm. The outer spring of the first bearing member 40 is, for its part, formed by winding a wire of 0.9 mm diameter and exhibits a stiffness coefficient of 5.55 N/mm. The stiffness of the first bearing member 40 is here equal to 10.43 dN/m.

The springs 41 and 41' are here helical compression springs produced in metal, for example in the alloy marketed under the marketing reference "Sandvik Springflex SHTM" by the company SANDVIK AB in Stockholm, Sweden. The springs 41 and 41' are formed by winding a wire of diameter, respectively, equal to 1.0 mm and 0.7 mm and exhibit a stiffness coefficient equal, respectively, to 9.66 N/mm and to 4.87 N/mm. The stiffness of the second bearing member 40' is here equal to 14.53 dN/m.

By virtue of this configuration of the bearing members 40 and 40', a circuit breaker 2 is obtained that is capable of operating with currents of high intensities, while retaining a satisfactory mechanical endurance.

In effect, when currents of high intensity circulate in the contact fingers 30, the latter are subjected to significant electromagnetic forces. It is therefore necessary to exert, on the contact fingers 30, a force which is greater than that exerted conventionally in the circuit breakers according to the prior art, where the intensity of the current is lower. In a first approach, the electromagnetic force exerted on a contact finger 30 is proportional to the square of the electrical current circulating in this contact finger 30.

Now, these electromagnetic forces exerted on the contact fingers 30 are not distributed uniformly along the row. On the contrary, they are greater for the contact fingers 30 situated in the lateral end zones E1 and E2 of the row than for the contact fingers 30 situated in the central part C1 of the row.

The bearing members 40' exhibiting a higher stiffness are thus placed in the lateral end zones E1 and E2, where the electromagnetic forces are the strongest. The first bearing members 40 exhibiting a lesser stiffness, are situated in the central part C1, where the electromagnetic forces are less strong. That nevertheless makes it possible to exert sufficient repulsion forces on the contact fingers 30.

It is not therefore necessary to replace the bearing members 40 situated in the central part C1 by bearing members of higher stiffness. This makes it possible to reduce the overall force exerted and therefore reduce the mechanical energy necessary to the closure of the displacement mechanism 18, which makes it possible to obtain a good mechanical endurance of the circuit breaker without needing to reinforce the mechanism 18.

Thus, a satisfactory compromise is obtained between, on the one hand, the need to exert a contact force necessary to keep the contact fingers 30 closed upon the passage of a current reaching the admissible rated short-term current and, on the other hand, the need to guarantee a good mechanical endurance of the circuit breaker 2.

As an illustrative example, the use of the bearing members 40 and 40' makes it possible to augment the performance levels of the circuit breaker 2, compared to a conventional circuit breaker, augmenting the overall force exerted by the bearing members 40 and 40' by only 13% in each pole. If bearing members of a same, higher stiffness, have been used, for all the contact fingers 30, the overall force provided by these bearing members would have had to be augmented by 33% for this pole. The stiffness of the bearing members would have had to be higher, which would have reduced the durability and the mechanical endurance of these bearing members and therefore of the circuit breaker 2.

Advantageously, the bearing members 40 and 40' have a similar height, for example equal to within 10% or, preferably, equal to within 5%. This height is measured along each bearing member 40, 40' when this bearing member is in a relaxed state.

In this way, the risks of buckling of the springs contained in the bearing members 40' or 40 during the displacement of the contact fingers 30 between their first and second positions are limited. That also allows the springs contained in the bearing members 40 and 40' to have a similar height when they are in a compressed state. The design of the frame 34 is then simplified thereby, since all the recesses 42, 42' can then have a same height.

Advantageously, the first bearing members 40 have a first outer diameter. The second bearing members 40' have a second outer diameter different from the first diameter.

For example, the second diameter is greater than the first diameter. The dimensions of the recesses 42, 42' are adapted accordingly.

As an illustration, the first diameter is here equal to 7.3 mm and the second diameter is equal to 6.3 mm.

In this example, the recesses 42 and 42' are therefore similar to one another and differ only by their diameter.

The different values of the first and second diameters simplify the manufacturing of the mobile electrical contact 12 by avoiding, in an industrial assembly phase, having one of the first bearing members 40 accidentally inserted into a recess 42' provided for one of the second bearing members 40'. The risk of a defect in the manufacturing of the circuit breaker 2 is thus reduced.

An example of the operation of the circuit breaker 2 is now described.

Initially, the circuit breaker 2 is in the closed position and allows the passage of the current for at least one pole. The electrical contacts 10 and 12 associated with this pole are in the closed position, as illustrated in FIG. 1. The contact pads 14 and 16 are in electrical contact with one another and allow the circulation of an electrical current between the terminals 6 and 8 of this pole of the circuit breaker 2. The contact pads 14 and 16 thus form a first electrical contact zone between the electrical contacts 10 and 12. The contact fingers 30 are held in their first position and the bearing members 40, 40' are held in a compressed state.

When the displacement mechanism 18 displaces the mobile electrical contact 12 about the axis X12 in the first direction of rotation F1, the contact fingers 30 pivot, under the action of the bearing members 40 and 40', from their first position to their second position, in the second direction of rotation F2.

As the mobile contact 12 continues to be displaced toward the open position, the contact pads 14 and 16 move away from one another, interrupting the first electrical contact zone and thus preventing the electrical current from circulating between these contact pads 14 and 16. At the same time, under the action of the bearing members 40 and 40', the contact fingers 30 are held in their second position.

Finally, in a phase following the displacement of the mobile electrical contact 12 to its open position, the first and second bearing members 40 and 40' are partially relaxed and the contact fingers 30 are at end of travel in their second position. An electrical arc then appears between the parts 32 and the contact pad 14. The electrical arc is then extinguished by means of the extinguishing chamber 20.

Many other embodiments are possible.

The mobile electrical contact 12 can have a different number of contact fingers 30, for example equal to nine or ten. In this case, the stiffness of the first and second bearing members 40, 40' can be adapted accordingly.

As a variant, the lateral end zones E1 and E2 can be defined so as to each encompass several contact fingers 30 of the row, for example two contact fingers 30.

As an example, the lateral end zones E1 and E2 can be defined in a first approach, for a given mobile electrical contact 12, from maximum values of the current circulating in the different contact fingers 30. For all of the contact fingers 30 of the mobile electrical contact 12, that can be represented by a curve representing the value of the current as a function of the position of the contact finger 30 along the row. This curve typically has a "U-shaped" parabolic form and extends between a minimum value and a maximum value, the minimum value being situated away from the ends of the row. The lateral end zones E1 and E2 are thus defined on either side of the row as being the regions of the row for which the value of the electrical current is greater than 1.5 times the minimum value, preferably greater than or equal to 1.8 times the minimum value. Corrections can be made to take account of the electromagnetic interactions between the different poles of the circuit breaker 2, such as torsional forces.

The bearing member associated with the contact finger 30 situated in the first lateral end zone E1 can exhibit a stiffness different from that of the bearing member associated with the contact finger 30 situated in the second lateral contact zone E2. However, it is preferable to use bearing members 40' that are identical to one another for the contact fingers 30 situated in the lateral end zones E1 and E2. The industrial manufacture of the mobile electrical contact 12 is simplified thereby, because there are then fewer spring and bearing member references to be managed during assembly.

The embodiments and the variants envisaged above can be combined with one another to generate new embodiments.

The invention claimed is:

1. An electrical circuit breaker with separable electrical contacts, comprising:

a fixed electrical contact, connected electrically to a first connection terminal of the circuit breaker; and a mobile electrical contact, connected to a second connection terminal of the circuit breaker, the mobile electrical contact being able to be displaced, relative to the fixed electrical contact, between open and closed positions of the electrical circuit breaker, the mobile electrical contact including:

several electrical contact fingers, arranged aligned along a row and that can be displaced relative to a frame of the mobile electrical contact, the contact fingers being adapted to ensure an electrical contact with the fixed electrical contact when the mobile electrical contact is in the closed position of the electrical circuit breaker, and several elastic bearing members each associated with a contact finger to exert a force on the contact finger in order to displace the contact finger, wherein the bearing members associated with the contact fingers situated in lateral end zones of the row exhibit a higher stiffness than the bearing members associated with the contact fingers situated in a central part of the row, the mobile contact comprises five contact fingers, each of the bearing members associated with the contact fingers situated in the lateral end zones of the row exerts a force greater than or equal to 12 dN on the corresponding contact finger, the bearing members associated with the contact fingers situated in the central part of the row exert a force greater than or equal to 9 dN and less than 12 dN on the corresponding contact finger, each elastic bearing member comprises an inner spring nested within an outer spring and arranged coaxially along a longitudinal axis of the elastic bearing member to exert together the force to displace the corresponding contact finger, the ratio between the stiffness of the bearing members associated with the contact fingers situated in the lateral end zones of the row and the stiffness of the bearing members associated with the contact fingers situated in the central part of the row lies within the range 1.33-2, and the stiffness coefficient of the inner spring is different from the stiffness coefficient of the outer spring in each of the bearing members.

2. The circuit breaker according to claim 1, wherein the inner and outer springs are helical compression springs.

3. The circuit breaker according to claim 1, wherein the bearing members associated with the contact fingers situated in the lateral end zones of the row exhibit a height similar to the height of the bearing members associated with the contact fingers situated in the central part of the row.

4. The circuit breaker according to claim 1, wherein the bearing members associated with the contact fingers situated in the lateral end zones of the row are identical to one another.

5. The circuit breaker according to claim 1, wherein the bearing members associated with the contact fingers situated in a central part of the row are identical to one another.

6. The circuit breaker according to claim 1, wherein the bearing members associated with the contact fingers situated in the lateral end zones of the row exhibit a height within less than 10% of the height of the bearing members associated with the contact fingers situated in the central part of the row.

7. The circuit breaker according to claim 1, wherein the bearing members associated with the contact fingers situated in the lateral end zones of the row exhibit a height within less than 5% of the height of the bearing members associated with the contact fingers situated in the central part of the row.

8. The circuit breaker according to claim 1, wherein each bearing member is received in a corresponding recess formed within the frame of the mobile electrical contact, wherein the bearing members associated with the contact fingers situated in the lateral end zones of the row have a first outer diameter, wherein the bearing members associated with the contact fingers situated in the central part of the row have a second outer diameter different from the first diameter.

9. The circuit breaker according to claim 8, wherein the second diameter is greater than the first diameter.

* * * * *